US007390963B2

(12) United States Patent
Scherer

(10) Patent No.: US 7,390,963 B2
(45) Date of Patent: Jun. 24, 2008

(54) METAL/CERAMIC COMPOSITE CONDUCTOR AND CABLE INCLUDING SAME

(75) Inventor: Richard J. Scherer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/422,985

(22) Filed: Jun. 8, 2006

(65) Prior Publication Data

US 2007/0284145 A1 Dec. 13, 2007

(51) Int. Cl.
*H01B 7/34* (2006.01)
*H01B 7/00* (2006.01)
*H01B 5/00* (2006.01)

(52) U.S. Cl. ..... 174/36; 174/120 R; 174/124 R; 174/126.1; 174/126.2

(58) Field of Classification Search ..... 174/36, 174/102 R, 103 R, 106 R, 110 R, 113 R, 174/120 R, 120 C, 126.1, 126.2, 126.4, 128.1, 174/128.2

See application file for complete search history.

(56) References Cited

U.S. PATENT DOCUMENTS 3,547,180 A 12/1970 Cochran et al.
3,864,807 A * 2/1975 Schneider et al. ..... 148/530
3,980,808 A * 9/1976 Kikuchi et al. ..... 174/110 SR
4,301,428 A 11/1981 Mayer
4,341,823 A * 7/1982 Sexton et al. ..... 427/404
4,659,007 A * 4/1987 Onishi et al. ..... 228/156
4,770,701 A * 9/1988 Henderson et al. ..... 75/232
4,839,238 A * 6/1989 Nakatani et al. ..... 428/614
4,987,394 A 1/1991 Harman et al.
5,045,527 A * 9/1991 Ikeno et al. ..... 505/410
5,061,823 A 10/1991 Carroll
5,169,831 A * 12/1992 Yamamoto et al. ..... 505/230
5,209,987 A * 5/1993 Penneck et al. ..... 428/610
5,223,349 A 6/1993 Kudo et al.
5,235,299 A 8/1993 Vaille et al.
5,244,748 A * 9/1993 Weeks et al. ..... 428/614
5,296,456 A * 3/1994 Shiga et al. ..... 505/230
5,424,282 A * 6/1995 Yamamoto et al. ..... 505/433
5,543,187 A * 8/1996 Errico et al. ..... 428/34.6
5,574,260 A 11/1996 Broomall et al.
5,866,252 A 2/1999 De Rochemont et al.
5,946,798 A 9/1999 Buluschek
5,959,245 A 9/1999 Moe et al.
6,037,068 A * 3/2000 de Rochemont et al. .... 428/689
6,037,545 A 3/2000 Fox et al.
6,245,425 B1 6/2001 McCullough et al.
6,307,156 B1 10/2001 Avellanet
6,397,454 B1 * 6/2002 Seuntjens et al. ..... 29/599
6,544,645 B1 4/2003 McCullough et al.
6,559,385 B1 * 5/2003 Johnson et al. ..... 174/126.1
6,576,844 B1 * 6/2003 Kamata ..... 174/126.1

(Continued)

FOREIGN PATENT DOCUMENTS

JP 2002-180218 A * 6/2002

(Continued)

*Primary Examiner*—William H. Mayo, III
(74) *Attorney, Agent, or Firm*—Johannes P. M. Kusters; Melanie G. Gover

(57) ABSTRACT

A conductor cable includes an inner portion and a conductive coating. The inner portion is formed of a metal/ceramic composite. The conductive coating is coated on the inner portion.

22 Claims, 1 Drawing Sheet

U.S. PATENT DOCUMENTS

| | | | | |
|---|---|---|---|---|
| 6,649,843 | B2 | 11/2003 | Aoyama et al. | |
| 7,015,395 | B2 | 3/2006 | Goldsworthy et al. | |
| 2002/0007546 | A1* | 1/2002 | Quick et al. | 29/419.1 |
| 2002/0198111 | A1* | 12/2002 | Tomsic | 505/230 |
| 2003/0032560 | A1* | 2/2003 | Otto et al. | 505/100 |
| 2003/0211355 | A1 | 11/2003 | Austin et al. | |
| 2005/0178000 | A1 | 8/2005 | McCullough et al. | |
| 2005/0181228 | A1 | 8/2005 | McCullough et al. | |
| 2005/0186410 | A1 | 8/2005 | Bryant et al. | |

FOREIGN PATENT DOCUMENTS

| | | | |
|---|---|---|---|
| JP | 2002-329426 | | 11/2002 |
| JP | 2003-086030 | | 3/2003 |
| JP | 2003-151380 | | 5/2003 |
| JP | 2005-294244 | A2 | 10/2005 |
| WO | WO 98/13835 | | 4/1998 |
| WO | WO 99-09562 | | 2/1999 |

* cited by examiner

METAL/CERAMIC COMPOSITE CONDUCTOR AND CABLE INCLUDING SAME

FIELD

The present invention relates generally to transmission cables. In particular, the invention relates to a metal and ceramic composite cable.

BACKGROUND

Cables for transmitting electrical signals are widely known and have come into extensive commercial use. Examples of such cables include coaxial and twinaxial cables. Coaxial cables generally consist of a signal, or inner, conductor and a metallic outer shield separated from the inner conductor by a dielectric material. Twinaxial cables generally consist of two signal conductors that are each surrounded by a dielectric material that separates the conductors from a common metallic shield.

Copper is a commonly used material for the inner conductor due to its high conductivity. However, copper is a very heavy metal and increases the weight of the cable, wiring harnesses, and interconnect systems used in devices for transmitting electrical signals or electrical power.

With cables being used in almost all commercial products using electronics, such as automobiles, aircraft, and handheld devices, reducing the weight of the cables is important for economic and energy consumption concerns. It would be beneficial to reduce the weight of hard goods over that which is currently available by reducing the weight of cables therein.

BRIEF SUMMARY

One embodiment of the present invention is a conductor cable that includes an inner portion and a conductive coating. The inner portion is formed of a metal/ceramic composite. The conductive coating is coated on the inner portion.

Another embodiment of the present invention is a transmission cable that includes at least one center conductor, a dielectric material, a metallic outer shield, and a jacket. The center conductor is formed of a metal and a ceramic composite and is coated with at least one conductive material. The dielectric material generally surrounds the center conductor. The metallic outer shield generally surrounds the dielectric material. The jacket envelops the metallic outer shield.

These and other aspects of the present application will be apparent from the detailed description below. In no event, however, should the above summaries be construed as limitations on the claimed subject matter, which subject matter is defined solely by the attached claims, as may be amended during prosecution.

While the above-identified figures set forth an embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION

Figure 1:
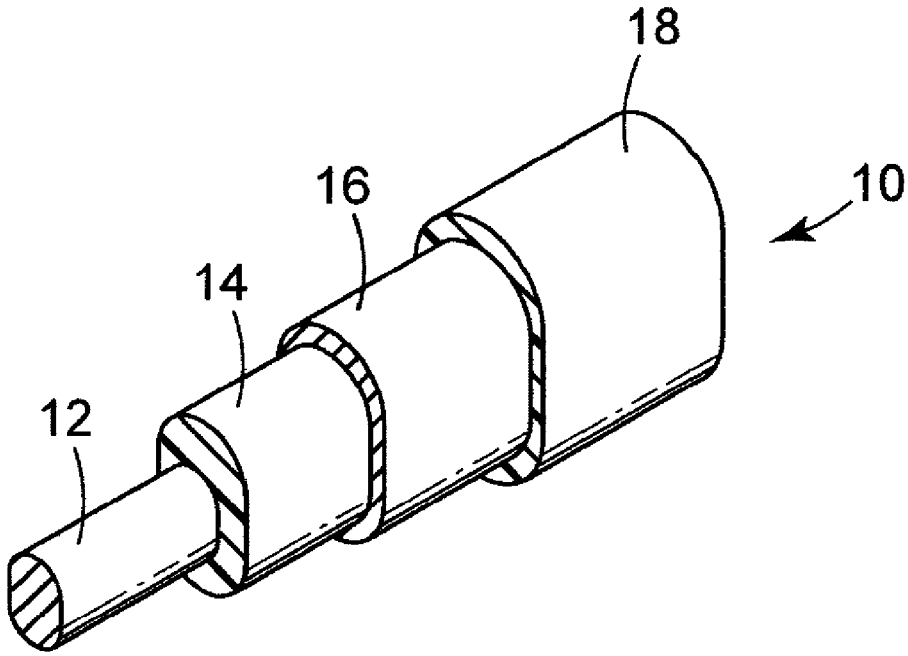
FIG. 1 is a partial sectional side perspective view of a coaxial cable according to an embodiment of the present invention.

FIG. 1 shows a partial sectional side perspective view of coaxial cable 10. Cable 10 includes conductor 12, dielectric sheath 14, metallic shield 16, and jacket 18. Dielectric sheath 14 is formed around conductor 12, metallic shield 16 is formed around dielectric sheath 14, and jacket 18 is formed around metallic shield 16 to form an outer protective casing for cable 10. Cable 10 can be constructed to have a reinforced design that decreases the likelihood of deformation of cable 10 when exposed to heat, which makes cable 10 particularly desirable when constructing devices where high electrical interconnect reliability and high bandwidth signaling are beneficial. Cable 10 can be any type of conducting cable including, but not limited to: a coaxial cable or a twinaxial cable.

Conductors currently used in the art for conductor 12 of cable 10 are typically formed from copper because of its high electrical conductivity and thermal stability. However, copper is also a heavier metal and can significantly increase the weight of the cable when used as the conductor material. When the weight of the cable is an important consideration, aluminum is commonly used to form the conductor. However, the electrical conductivity of aluminum is not as high as copper. Thus, depending on the desired properties of the cable, different metals can be used to form the conductor. For example, it takes approximately 50% more aluminum by weight to carry the same amount of current as copper.

Figure 2:
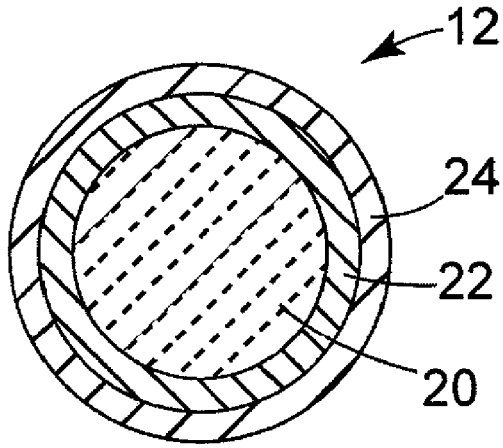
FIG. 2 is a cross-sectional view of a conductor according to an embodiment of the present invention.

FIG. 2 shows a cross-sectional view of conductor 12 (for use with cable 10, for example) according to an embodiment of the present invention, having a metal and ceramic composite base 20 plated or clad with a conductive layer such as copper layer 22 and a second conductive layer such as silver layer 24. These layers are not required to be copper and silver respectively, but layer 22 should be more conductive than composite base 20 and silver layer 24 should be more conductive than layer 22. U.S. Pat. No. 5,223,349 (Kudo et al., assigned to Sumitomo Electric Industries, Ltd., Osaka, Japan) discloses a method of making the center conductor composite by cladding. U.S. Pat. No. 5,574,260 (Broomall et al., assigned to W.L. Gore & Associates, Inc., Newark, Del.) discloses a method of calculating the amount of metal to clad based on electrical performance of the composite conductor.

Copper layer 22 on metal and ceramic composite base 20 functions to electrically enhance conductor 12. By using copper layer 22 as the contact interface with a connector, conductor 12 provides high electrical interconnect reliability. High bandwidth signaling is also achieved by conductor 12 by plating or cladding a layer of silver layer 24 over copper layer 22. In signaling, the outer surface area of the conductor is crucial to signal attenuation properties. As the signal frequency increases, the outer surface carries the majority of the signal. Thus, at higher frequencies, it is beneficial to provide an electrically conductive coating on the outer surface of the conductor. A typical bandwidth of conductor 12 achieved by this plating/cladding configuration with metal and ceramic composition base 20 (where copper is employed as the metal) is between approximately 100 mega Hertz (MHz) and approximately 20 giga Hertz (GHz). Copper layer 22 and silver layer 24 are plated onto metal and ceramic composite base 20 of conductor 12 by any method known in the art. For example, copper can be plated on metal and ceramic composite base 20 by flash electroplating followed by fusing. Copper can also be plated on metal and ceramic composite base 20 by etching with a copper bath followed by fusing. Although metal and ceramic composite base 20 are discussed as having a copper and silver conductive coating, metal and ceramic composite base 20 can also be coated with other materials, including, but not limited to: copper alloys, gold, tin, lead, indium tin oxide, non-metallic materials with conductive particles, and non-metallic materials coated with conductive material The metal element of metal and ceramic composite base 20 is chosen based on the desired characteristics of the resulting product, and can include, but is not limited to: copper, aluminum, silver, and the like. For example, copper will be chosen over aluminum when increased electrical conductivity and thermal stability are desired properties of cable 10. Conversely, when decreased weight and/or thickness are more important properties of cable 10, aluminum, which is lighter than copper, is used as the metal element.

The ceramic element of metal and ceramic composite base 20 of conductor 12 is a non-metallic fiber, such as metal oxide (e.g. alumina) fibers or boron fibers. When the ceramic element is formed of metal oxide fibers, the fibers are crystalline ceramics and/or a mixture of crystalline ceramic and glass (i.e. a fiber may contain both crystalline ceramic and glass phases). Typically, the continuous reinforcing fibers have an average fiber diameter of between approximately 5 micrometers and approximately 50 micrometers and a length on the order of at least about 50 meters. This means that the fiber has an aspect ratio (i.e. ratio of the length of the fiber to the average diameter of the fiber) of at least $1\times10^5$.

Alumina fibers are described, for example, in U.S. Pat. Nos. 4,954,462 and 5,185,299 (Woods et al., assigned to Minnesota Mining and Manufacturing Company, St. Paul, Minn.), which are herein incorporated by reference. In some embodiments, the alumina fibers are polycrystalline alpha alumina fibers and comprise, on a theoretical oxide basis, greater than 99 percent by weight $Al_2O_3$ and 0.2-0.5 percent by weight $SiO_2$, based on the total weight of the alumina fibers. Some desirable polycrystalline, alpha alumina fibers comprise alpha alumina having an average grain size of less than 1 micrometer. Exemplary alpha alumina fibers are marketed under the trade designation "NEXTEL 610" by 3M Company, St. Paul, Minn.

Aluminosilicate fibers are described, for example, in U.S. Pat. No. 4,047,965 (Karst et al., assigned to 3M Company, St. Paul, Minn.), which is herein incorporated by reference. Exemplary aluminosilicate fibers are marketed under the trade designations "NEXTEL 440", "NEXTEL 550", and "NEXTEL 720" by 3M Company, St. Paul, Minn.

Aluminoborosilicate fibers are described, for example, in U.S. Pat. No. 3,795,524 (Snowman, assigned to 3M Company, St. Paul, Minn.), which is herein incorporated by reference. Exemplary aluminoborosilicate fibers are marketed under the trade designations "NEXTEL 312" by 3M Company, St. Paul, Minn.

In at least one embodiment, metal and ceramic composite base 20 is a fiber reinforced metal matrix composite comprising continuous polycrystalline fibers encapsulated within either a matrix of the metal, for example, or an alloy of the metal. As used herein, the term "polycrystalline" means a material having predominantly a plurality of crystalline grains in which the grain size is less than the diameter of the fiber in which the grains are present. The term "continuous" is intended to mean a fiber having a length that is relatively infinite when compared to the fiber diameter.

The process of making a metal matrix composite often involves forming fibers into a "preform". Typically, fibers are wound into arrays and stacked. Fine diameter fibers are wound so that fibers stay parallel to one another. The stacking is done in any fashion to obtain a desired fiber density in the final composite. Fibers can be made into simple preforms by winding around a rectangular drum, a wheel, or a hoop. Alternatively, they can be wrapped onto a cylinder. The multiple layers of fibers wound or wrapped in this fashion are cut off and stacked or bundled together to form a desired shape. Handling the fiber arrays is aided by using water either straight or mixed with an organic binder to hold the fibers together in a mat.

One method of making a composite part is to position the fibers in a mold, fill the mold with molten metal, and then subject the filled mold to elevated pressure. Such a process is disclosed in U.S. Pat. No. 3,547,180 entitled, "Production of Reinforced Composites". The mold should not be a source of contamination to the matrix metal. The fibers can be stacked in the mold in a desired configuration; e.g. parallel to the walls of the mold, or in layers arrayed perpendicular to one another, as is known in the art. The shape of the composite material can be any shape into which a mold can be made. As such, fiber structures can be fabricated using numerous preforms, including, but not limited to: rectangular drums, wheel or hoop shapes, cylindrical shapes, or various molded shapes resulting from stacking or otherwise loading fibers in a mold cavity. Each of the preforms described above relates to a batch process for making a composite device. Continuous processes for the formation of substantially continuous wires, tapes, cables, and the like may be employed as well.

Metal and ceramic composite base 20 can be formed by infiltrating bundles or tows of ceramic fiber with molten metal. This can be done by feeding tows of fibers into a bath of molten metal. To obtain wetting of the fibers, an ultrasonic horn is used to agitate the bath as the fibers pass through it. This, and other processes for making metal and ceramic composite base 20 are described in U.S. Pat. No. 6,544,645 and U.S. Pat. Appl. Publ. 2005/0178000 (McCullough et al., assigned to Minnesota Mining and Manufacturing Company, St. Paul, Minn.), and U.S. Pat. No. 6,559,385 (Johnson et al., assigned to Minnesota Mining and Manufacturing Company, St. Paul, Minn.), which are herein incorporated by reference. Although FIG. 2 depicts conductor 12 as having a circular cross-section, conductor 12 can have any variety of cross-sectional shapes, including, but not limited to: ovate, elliptical, capsule-shaped, flattened, rectangular, oblong curvilinear, and egg-shaped. Conductor 12 may also be formed from either a stranded or a solid element.

Metal and ceramic composite base 20 allows for increased resistance to warping and deformation of conductor 12. As previously mentioned, copper is more thermally stable than aluminum due to its lower coefficient of thermal expansion. However, the thermal expansion properties of aluminum can be increased to perform similarly to copper by adding fibers to the aluminum. Additionally, a metal and ceramic composite base 20 using aluminum significantly reduces the weight of conductor 12 by reducing the amount of copper in cable 10. In one embodiment, conductor 12 has an American Wire Gage (AWG) size of no greater than approximately 0000 AWG and weight of no greater than approximately 140 pounds per 1000 feet (lbs/1000 ft). At 40 AWG, conductor 12 has a diameter of approximately 0.07874 millimeters (mm). At 0000 AWG, conductor 12 has a diameter of approximately 11.684 mm. A copper/ceramic composite based conductor having an AWG of between 40 and 0000 has a weight of between approximately 0.0063 lbs/1000 ft and approximately 138.24 lbs/1000 ft. An aluminum/ceramic composite based conductor having an AWG of between 40 and 0000 has a weight of between approximately 0.0033 lbs/1000 ft and approximately 73.64 lbs/1000 ft. Thus, depending on the desired properties of conductor 12, different metals in various weight percentages are used to form metal and ceramic composite base 20. In one embodiment, conductor 12 constitutes approximately 48% copper by weight and approximately 52% ceramic material by weight. In an alternative embodiment, conductor 12 constitutes approximately 45% aluminum by weight, approximately 2-4% copper by weight, and the remainder ceramic material.

Referring back to FIG. 1, dielectric sheath 14 is formed around conductor 12 to provide insulation between conductor 12 and metallic shield 16. The thickness of dielectric sheath 14 is adjustable to control the impedance of cable 10. This is due to the fact that the thickness of dielectric sheath 14 controls the spacing between conductor 12 and metallic shield 16. In one embodiment, dielectric sheath 14 is extruded over conductor 12. In another embodiment, dielectric sheath 14 is applied on conductor 12 as a twisted or wrapped filament made of a dielectric material. Exemplary materials that may be used for dielectric sheath 14 include, but are not limited to: polyvinyl chloride (PVC), fluoropolymers including perfluoroalkoxy (PFA), fluorinated ethylene propylene (FEP), and foamed fluorinated ethylene propylene (FFEP), and polyolefins such as polyethylene (PE), foamed polyethylene (FPE), polypropylene (PP), and polymethyl pentane. In an alternative embodiment, dielectric sheath 14 may comprise a dielectric tube and solid core filament spacer to define an air core surrounding conductor 12, such as that shown and described in U.S. Pat. No. 6,849,799 (Springer et al., assigned to 3M Innovative Properties Company, St. Paul, Minn.), the teachings of which are herein incorporated by reference.

Metallic shield 16 is formed around dielectric sheath 14 to shield conductor 12 from producing external electromagnetic interference (EMI). Metallic shield 16 also helps to prevent signal interference from electromagnetic and electrostatic fields external to cable 10. Furthermore, metallic shield 16 provides a continuous ground for cable 10. Metallic shield 16 may have a variety of configurations, including, but not limited to: a metallic braid, a served shield, a metal foil, or combinations thereof. In one embodiment, metallic shield 16 is formed of the same materials as conductor 12 and is would around dielectric sheath 14. In an alternative embodiment, metallic shield 16 is formed of a silver plated fabric material.

Jacket 18 is formed around metallic shield 16 and provides a protective coating for cable 10 and support for the components of cable 10. Jacket 18 also insulates the components of cable 10 from external surroundings. Jacket 18 can be formed of a flexible rubber material or a flexible plastic material, such as FFEP, to permit installation of cable 10 around obstructions and in tortuous passages. Other materials can also be used for jacket 18, including, but not limited to: ethylene propylene diene elastomer, mica tape, neoprene, PE, PP, PVC, PFA, FEP, polymethyl pentane, silicon, and rubber.

Cable 10 can be made by any suitable method known in the art such as those described in U.S. Pat. Nos. 4,987,394, 5,235,299, 5,946,798, and 6,307,156 B1; U.S. patent application 2003/0211355 A1; Japanese Pat. Nos. 2003-151380, 2003-86030, 2002-329426; and PCT Pat. Appl. 98/13835.

The cable of the present invention includes a conductor made of a metal and ceramic composite base that has increased strength and thermal stability. Due to the lower coefficient of thermal expansion of the ceramic materials used to construct the conductor, the cable does not expand and contract as significantly as cables currently available. The reinforced cable of the present invention thus exhibits decreased sagging when exposed to changing localized temperatures. Plating or cladding the metal and ceramic composite base with copper and silver also increases the interconnect reliability and bandwidth signaling of the cable. The cable can also be designed to have reduced weight and thickness depending on the metal used in the conductor, making it desirable for use in coaxial or twinaxial cabling applications, particularly for use with automobiles, aircraft, and handheld devices.

Although the present invention has been described with reference to preferred embodiments, workers skilled in the art will recognize that changes may be made in form and detail without departing from the spirit and scope of the invention.

The invention claimed is:

1. An article comprising:

a high frequency signal transmission conductor including an inner portion formed of a metal/ceramic composite, wherein the ceramic component of the composite includes non-metallic fibers embedded in the metal component of the composite; and a first conductive coating on the inner portion, wherein the first conductive coating is more conductive than the inner portion.

2. The article of claim 1, wherein the metal/ceramic composite includes aluminum.

3. The article of claim 2, wherein the conductor weighs between approximately 0.0033 pounds per 1000 feet and approximately 73.64 pounds per 1000 feet.

4. The article of claim 1, wherein the metal/ceramic composite includes copper.

5. The article of claim 4, wherein the conductor weighs between approximately 0.0063 pounds per 1000 feet and approximately 138.24 pounds per 1000 feet.

6. The article of claim 1, wherein the first conductive coating is formed of a material selected from the group consisting of copper, copper alloys, gold, tin, lead, indium tin oxide, non-metallic materials with conductive particles, and non-metallic materials coated with conductive material.

7. The article of claim 1, wherein the conductor has a diameter of between approximately 0.07874 millimeters and approximately 11.684 millimeters.

8. The article of claim 1, wherein the conductor weighs no greater than approximately 140 pounds per 1000 feet.

9. A transmission cable, the cable comprising:

at least one high frequency signal transmission center conductor including an inner portion formed of a metal/ceramic composite, wherein the ceramic component of the composite includes non-metallic fibers embedded in the metal component of the composite; and a first conductive coating on the inner portion, wherein the first conductive coating is more conductive than the inner portion;

a dielectric material generally surrounding the center conductor;

a metallic outer shield generally surrounding the dielectric material; and a jacket enveloping the metallic outer shield.

10. The transmission cable of claim 9, wherein the metal/ceramic composite includes aluminum.

11. The transmission cable of claim 10, wherein the center conductor has a weight of between approximately 0.0033 pounds per 1000 feet and approximately 73.64 pounds per 1000 feet.

12. The transmission cable of claim 9, wherein the metal/ceramic composite includes copper.

13. The transmission cable of claim 12, wherein the center conductor has a weight of between approximately 0.0063 pounds per 1000 feet and approximately 138.24 pounds per 1000 feet.

14. The transmission cable of claim 9, wherein the first conductive coating is formed of a material selected from the group consisting of copper, copper alloys, gold, tin, lead, indium tin oxide, non-metallic materials with conductive particles, and non-metallic materials coated with conductive material.

15. The transmission cable of claim 9, wherein the center conductor has a diameter of between approximately 0.07874 millimeters and approximately 11.684 millimeters.

16. The transmission cable of claim 9, and further comprising a plurality of center conductors.

17. The transmission cable of claim 9, wherein the metallic outer shield is formed of a metal/ceramic composite.

18. The transmission cable of claim 9, wherein the center conductor weighs less than approximately 140 pounds per 1000 feet.

19. The article of claim 1, wherein the conductor further includes a second conductive coating on the first conductive coating, wherein the second conductive coating is more conductive than the first conductive coating.

20. The article of claim 19, wherein the second conductive coating is silver.

21. The transmission cable of claim 9, wherein the conductor further includes a second conductive coating on the first conductive coating, wherein the second conductive coating is more conductive than the first conductive coating.

22. The transmission cable of claim 21, wherein the second conductive coating is silver.

* * * * *